United States Patent [19]

Flint, Jr.

[11] Patent Number: 4,844,200

[45] Date of Patent: Jul. 4, 1989

[54] END CAP FOR EXTENSION PLANKS OR THE LIKE

[75] Inventor: William A. Flint, Jr., Woodbridge, Conn.

[73] Assignee: A. W. Flint Company, Inc., New Haven, Conn.

[21] Appl. No.: 190,383

[22] Filed: May 5, 1988

[51] Int. Cl.[4] ..... E04G 5/08

[52] U.S. Cl. ..... 182/18; 182/223

[58] Field of Search ..... 182/222, 223, 46, 18, 182/178, 179

[56] References Cited

U.S. PATENT DOCUMENTS

| | | | |
|---|---|---|---|
| 4,014,405 | 3/1977 | Breisch | 182/46 |
| 4,726,446 | 2/1988 | Perbix | 182/107 |
| 4,768,620 | 9/1988 | South | 182/223 |

FOREIGN PATENT DOCUMENTS

| | | | |
|---|---|---|---|
| 1135883 | 1/1985 | U.S.S.R. | 182/222 |

*Primary Examiner*—Reinaldo P. Machado
*Attorney, Agent, or Firm*—John H. Crozier

[57] ABSTRACT

There is provided, in a preferred embodiment, an end cap for the rails of an extension plank or the like in the form of a molded one-piece open box which fits over the ends of a set of rails, with the ends of the rails being fastened together therein in spaced apart relation by means of rivets or other fasteners extending through holes which may be formed in the end cap during the molding process. The end cap is preferably formed of an injection-molded thermoplastic, such as an acrylonitrile-butadiene-styrene material. Manufacturing steps, such as grinding of sharp corners, cutting to length, and forming of holes, required by conventional end pieces are eliminated. Maximum-load safety warnings may be permanently molded into the end cap.

14 Claims, 1 Drawing Sheet

FIG. 1
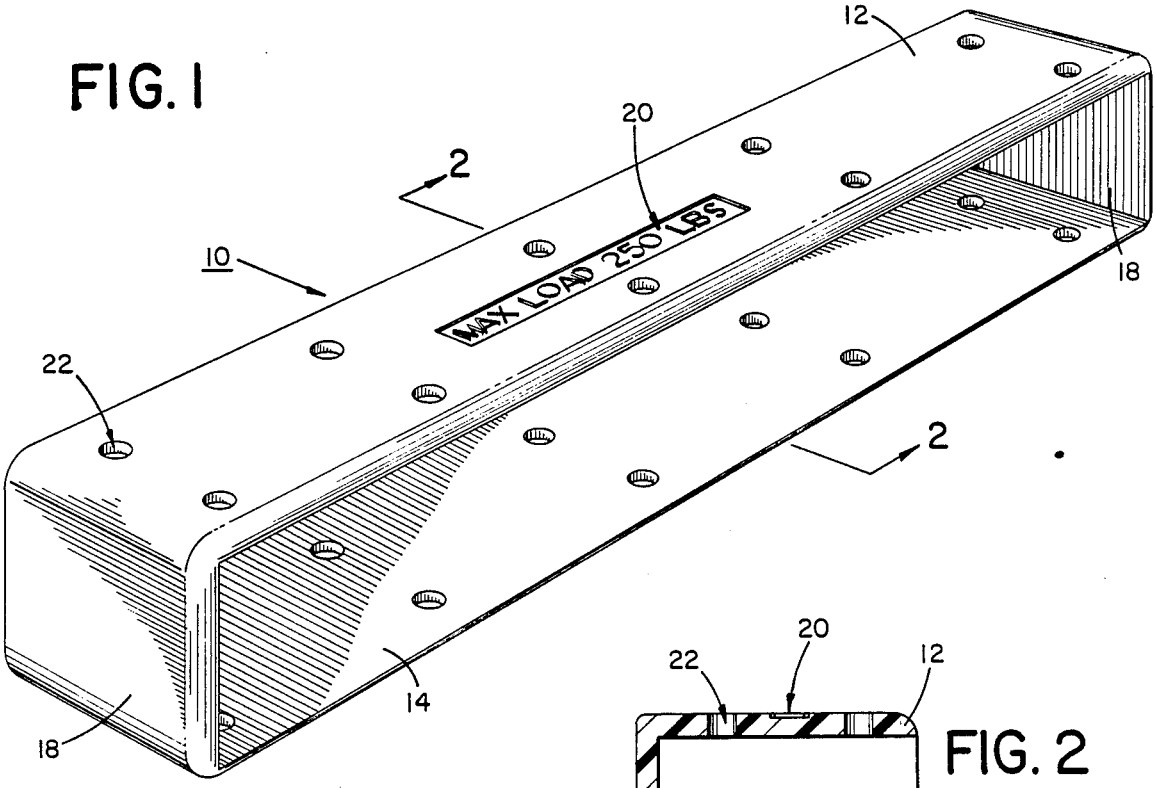
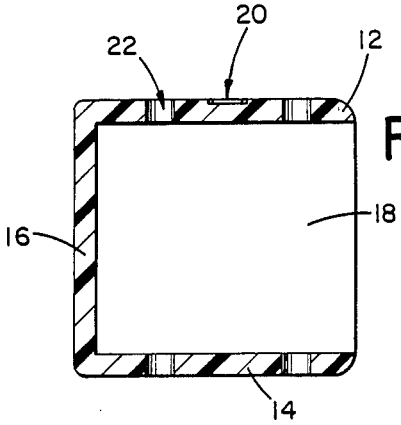
FIG. 2
FIG. 3
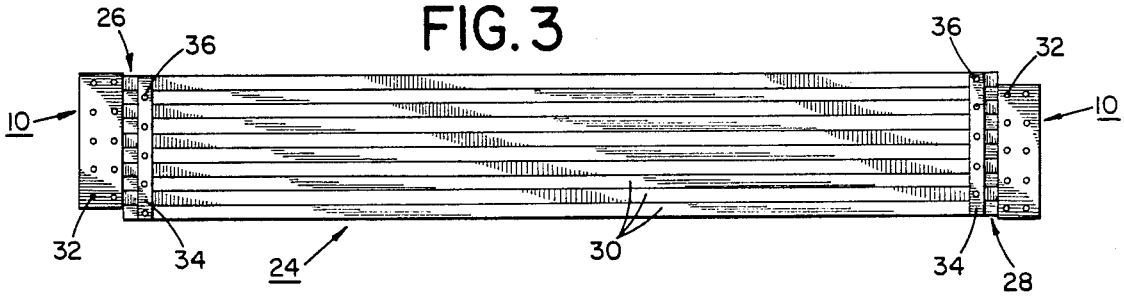
FIG. 4
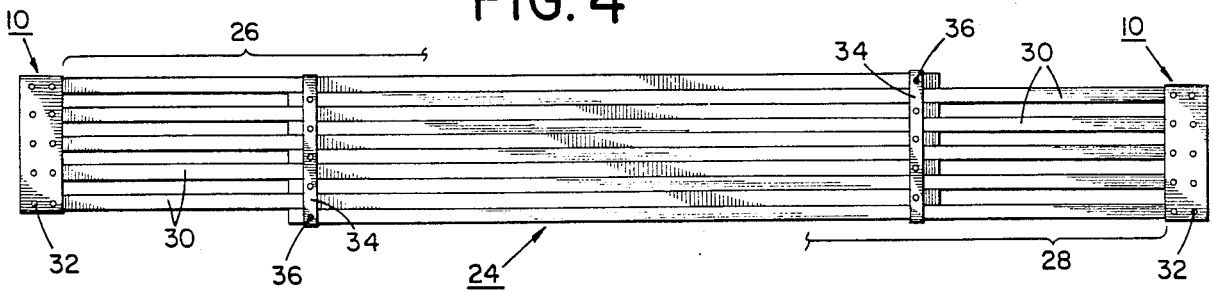

END CAP FOR EXTENSION PLANKS OR THE LIKE

BACKGROUND OF THE INVENTION

1. Field of the Invention.

The present invention relates generally to extension planks having interleaved rails and, more particularly, to a novel end cap for extension planks or the like.

2. Background Art.

An extension plank is a well known device which is used typically for providing an elevated work platform which may be supported between ladder jacks and frequently comprises two sets of a plurality of interleaved telescoping rails to provide variable length of the work platform. Extension planks of the type considered here are manufactured, for example, by A. W. Flint Company, New Haven, Conn. Such an extension plank may provide a work platform on the order of six to ten feet in length. For longer lengths, say on the order of eight to sixteen feet, a third set of interleaved rails may be provided for greater stability. In either case, the length of the extension plank is adjusted by longitudinally drawing the distal end of one set of rails away from the end(s) of the other set(s). The rails are typically constructed of wood, aluminum, or fiberglass.

So that the sets of rails may be so adjusted conveniently, the distal ends of the rails are attached together in spaced apart relation by end pieces so that all rails in that set will move together. Conventionally, the means for effecting this attachment have taken one of two forms. In one method, two strips of steel, or other suitable metal or material, are placed one on the top sides and one on the bottom sides of the ends of one rails of a set and the two strips are then riveted or otherwise connected through each rail so that the rails in that set are held apart by approximately the width of the rail and are secured for common movement relative to the other set(s) of rails. In the other method, a metal end cap or channel with open sides, formed of aluminum, for example, may be used to provide the top and bottom members while also covering the ends of the rails. The rails are held in place, as above, by rivets or other fasteners extending between the top and bottom members and through the ends of the rails.

The two conventional structures have the disadvantage of requiring the steps of cutting the metal end pieces to the necessary length and then forming the holes, by means of drilling or punching, to accommodate the fasteners. Additionally, both conventional structures present sharp metal corners which must be ground off in a further manufacturing step. These steps contribute a significant labor cost increment to the final product. Also, an important safety feature, that of a maximum-load warning label adhesively applied to the end piece and/or one or more rails, may be destroyed by weathering, exposure to water or chemicals, covering with paint, and/or vandalism.

Accordingly, it is a principal object of the present invention to provide an end cap for an extension plank or the like which presents no sharp corners requiring grinding during the manufacture of the plank.

Another object of the invention is to provide such an end cap that does not require a separate manufacturing step to form holes for fasteners.

An additional object of the invention is to provide such an end cap that does not require a cutting step during manufacture.

A further object of the invention is to provide such an end cap which may incorporate a maximum-load safety warning as an integral part thereof.

Yet another object of the invention is to provide such an end cap which is simply and economically manufactured.

Other objects of the invention, as well as particular features and advantages thereof will, in part, be obvious and will, in part, be apparent from the following description and the accompanying drawing figures.

SUMMARY OF THE INVENTION

The present invention accomplishes the above objects, among others, by providing, in a preferred embodiment, an end cap for the rails of an extension plank or the like in the form of a molded one-piece open box which fits over the ends of a set of rails, with the ends of the rails being fastened together therein in spaced apart relation by means of rivets or other fasteners extending through holes which may be formed in the end cap during the molding process. The end cap is preferably formed of an injection-molded thermoplastic, such as an acrylonitrile-butadiene-styrene material. Manufacturing steps, such as grinding of sharp corners, cutting to length, and forming of holes, required by conventional end pieces are eliminated. Maximum-load safety warnings may be permanently molded into the end cap.

BRIEF DESCRIPTION OF THE DRAWING

FIG. 1 is a perspective view of the end cap of the present invention.

FIG. 2 is a sectional view of the end cap of FIG. 1.

FIG. 3 is a top plan view of an extension plank incorporating the end caps of the present invention, in a unextended position.

FIG. 4 if a top plan view of the extension plank of FIG. 3 in an extended position.

DESCRIPTION OF THE PREFERRED EMBODIMENTS

Referring now to the Drawing, FIG. 1 is a perspective view of the end cap of the present invention, generally indicated by the reference numeral 10, and Figure 2 is a cross-sectional view thereof. End cap 10 includes top, bottom, end, and side members 12, 14, 16, and 18, respectively, forming a monolithic, open, rectilinear, boxlike structure as shown, with one edge each of the top, bottom, and side members defining a rectangular opening. One or more of the members may include an integral maximum-load safety warning 20. Top 12 and bottom 14 have formed therein holes, as at 22, to accommodate therebetween rivets or other fasteners.

FIG. 3 shows end caps 10 installed on an extension plank, generally indicated by the reference numeral 24, which includes two sets, 26 and 28, of rails, as at 30. FIG. 3 shows extension plank 24 in an unextended position, while FIG. 4 shows the plank in an extended positions. One end cap 10 is disposed over the distal ends of rails 30 in each set 26 and 28, with the distal ends of the rails being fastened thereto by means of rivets or other fastener means extending between oppositely disposed holes 22 in top and bottom members 12 and 14, respectively, and through each rail end. The inside, facing, parallel surfaces of top 12 and bottom 14 are space apart by approximately the height of a rail 30 and the pairs of holes 22 fastening one distal rail end are spaced apart from the pairs of holes fastening the adjacent distal rail end by approximately two rail widths. Of course, a rail 30 could be fastened by only one pair of fastener means, but it has been found preferable to employ at least two pairs for each rail end.

Internal ends of sets 26 and 28 of rails 30 are fastened together in spaced apart relation by bands 34 and fasteners, as at 36, as shown.

End cap 10 is preferably formed of an injection molded thermoplastic, such as an acrylonitrile-butadiene-styrene material, so that rounded edges of top, bottom, end, and side members 12, 14, 16, and 18 as well as fastener holes 22 may be formed in the molding step and do not require separate manufacturing steps. Also, integral maximum-load warning 20 is molded into one or more of the members during the molding process and, therefore is permanently part of end cap 10, thus providing for permanent transmittal of safety information as part of the final product.

While the present invention has been described as being applied to an extension plank, it will be understood that it may be applied as well by one skilled in the art to a nonextending plank and to any other article in which it is necessary to secure the ends of a number of individual elements.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An end cap to secure the ends of two or more elements, comprising:

(a) an open, molded, box-like structure having rounded edges and having (i) a top member, (ii) a bottom member parallel to said top member, (iii) an end member orthogonal to said top and bottom members and joining said top and bottom members, and (iv) two side members orthogonal to said top, bottom, and end members and joining said top, bottom, and end members; and (b) one edge each of said top, bottom, and side members together defining an opening into which one end of each of said elements may be inserted and joined by fasteners inserted through oppositely disposed pairs of holes formed in said top and bottom members.

2. An end cap, as defined in claim 1, wherein said molded structure is injection molded with an acrylonitrile-butadiene-styrene material.

3. An end cap, as defined in claim 1, wherein said molded structure includes a maximum-load safety warning as an integral part thereof.

4. An end cap for an extension plank or the like, said extension plank comprising two sets of a plurality of interleaved rails, said rails of each said set having internal ends and distal ends, comprising:

(a) an open, molded, box-like structure having rounded edges and having (i) a top member, (ii) a bottom member parallel to said top member, (iii) an end member orthogonal to said top and bottom members and joining said top and bottom members, and (iv) two side members orthogonal to said top, bottom, and end members and joining said top, bottom, and and end members; and (b) one edge each of said top, bottom, and side members together defining an opening into which said distal ends of one said set of said rails may be inserted and joined by fasteners inserted through pairs of oppositely disposed holes formed in said top and bottom members.

5. An end cap, as defined in claim 4, wherein said molded structure is injection molded with an acrylonitrile-butadiene-styrene material.

6. An end cap, as defined in claim 4, wherein said molded structure includes a maximum-load safety warning as an integral part thereof.

7. An end cap to secure the ends of two or more elements, comprising:

(a) an open, molded, box-like structure having (i) a top member, (ii) a bottom member parallel to said top member, (iii) an end member orthogonal to said top and bottom members and joining said top and bottom members, and (iv) two side members orthogonal to said top, bottom, and end members and joining said top, bottom, and end members;

(b) one edge each of said top, bottom, and side members together defining an opening into which said ends of said elements may be inserted; and p1 (c) said molded, box-like structure includes a maximum-load safety warning as an integral part thereof.

8. An end cap, as defined in claim 7, further comprising at least one pair of oppositely disposed holes formed in said top and bottom members to accommodate fastener means to secure one of said ends of one of said members within said end cap.

9. An end cap, as defined in claim 7, wherein said molded structure is injection molded with an acrylonitrile-butadiene-styrene material.

10. An end cap, as defined in claim 7, wherein said molded structure is formed with rounded edges.

11. An end cap for an extension plank or the like, said extension plank comprising two sets of a plurality of interleaved rails, said rails of each said set having internal ends and distal ends, comprising:

(a) an open, molded, box-like structure having (i) a top member, (ii) a bottom member parallel to said top member, (iii) an end member orthogonal to said top and bottom members and joining said top and bottom members, and (iv) two side members orthogonal to said top, bottom, and end members and joining said top, bottom, and and end members;

(b) one edge of said top, bottom, and side members together defining an opening into which said distal ends of one said set of said rails may be inserted; and (c) said molded, box-like structure includes a maximum-load safety warning as an integral part thereof.

12. An end cap, as defined in claim 11, further comprising at least one pair of oppositely disposed holes formed in said top and bottom members to accommodate fastener means to secure said distal end of one said rail within said end cap.

13. An end cap, as defined in claim 11, wherein said molded structure is injection molded with an acrylonitrile-butadiene-styrene material.

14. An end cap, as defined in claim 11, wherein said molded structure is formed with rounded edges.

* * * * *